US011479883B2

(12) United States Patent
Moravec et al.

(10) Patent No.: US 11,479,883 B2
(45) Date of Patent: Oct. 25, 2022

(54) YARN RETURN UNIT FOR RETURNING A YARN AS WELL AS A WORKSTATION OF A TEXTILE MACHINE COMPRISING A YARN RETURN UNIT

(71) Applicant: Maschinenfabrik Rieter AG, Winterthur (CH)

(72) Inventors: Milan Moravec, Usti nad Orlici (CZ); Jiri Sloupensky, Dolni Sloupnice (CZ); Andreas Josef Pröll, St. Gotthard (AT); Peter Dirnberger, St. Florian (AT)

(73) Assignee: Maschinenfabrik Rieter AG, Winterthur (CH)

( * ) Notice: Subject to any disclaimer, the term of this patent is extended or adjusted under 35 U.S.C. 154(b) by 17 days.

(21) Appl. No.: 16/874,901

(22) Filed: May 15, 2020

(65) Prior Publication Data

US 2020/0362480 A1 Nov. 19, 2020

(30) Foreign Application Priority Data

May 15, 2019 (DE) ..... 10 2019 112 735.1

(51) Int. Cl.
*D01H 4/10* (2006.01)
*D01H 4/12* (2006.01)

(52) U.S. Cl.
CPC ..... *D01H 4/10* (2013.01); *D01H 4/12* (2013.01)

(58) Field of Classification Search
CPC .. D01H 4/10; D01H 4/12; D01H 4/14; D01H 4/44; D01H 7/04; F16C 32/04; G01B 7/00
See application file for complete search history.

(56) References Cited

U.S. PATENT DOCUMENTS

| | | | | |
|---|---|---|---|---|
| 5,557,916 | A * | 9/1996 | Messmer | D01H 4/50 57/261 |
| 5,973,468 | A | 10/1999 | Yamauchi | |
| 6,770,992 | B2 | 8/2004 | Yamauchi | |
| 9,689,658 | B2 * | 6/2017 | Moravec | D01H 4/44 |
| 9,945,417 | B2 * | 4/2018 | Moravec | F16C 32/04 |
| 2002/0047404 | A1 * | 4/2002 | Coenen | F16F 15/18 310/90.5 |

(Continued)

FOREIGN PATENT DOCUMENTS

| | | |
|---|---|---|
| DE | 44 09 992 A1 | 9/1995 |
| DE | 694 16 885 T2 | 11/1999 |

(Continued)

OTHER PUBLICATIONS

German Patent Office Search Report, dated Mar. 13, 2020.

*Primary Examiner* — Shaun R Hurley
(74) *Attorney, Agent, or Firm* — Dority & Manning, P.A.

(57) ABSTRACT

A method is provided for identifying a spinning rotor on a rotor spinning machine, wherein the spinning rotor is mounted in a suspended manner in a radially acting magnetic bearing during a spinning operation. At least one system variable that varies between different spinning rotors is identified. The system variable is detected and compared to at least one reference value. The system variable is one or a combination of: an energy consumption of the magnetic bearing; a radial position of the spinning rotor; or a resonant frequency of the spinning rotor. A rotor spinning machine that carries out the method is also provided.

15 Claims, 2 Drawing Sheets

(56) References Cited

U.S. PATENT DOCUMENTS

| | | | | |
|---|---|---|---|---|
| 2003/0080638 | A1 | 5/2003 | Shinozaki | |
| 2009/0308285 | A1 | 12/2009 | Bode et al. | |
| 2014/0285046 | A1* | 9/2014 | Moravec | F16C 32/0446 310/90.5 |
| 2014/0285185 | A1 | 9/2014 | Moravec et al. | |
| 2018/0238388 | A1* | 8/2018 | Burchert | F16C 32/0474 |

FOREIGN PATENT DOCUMENTS

| | | | |
|---|---|---|---|
| DE | 10 2007 028 935 | A1 | 12/2008 |
| WO | WO 2008/080372 | A1 | 7/2008 |

* cited by examiner

YARN RETURN UNIT FOR RETURNING A YARN AS WELL AS A WORKSTATION OF A TEXTILE MACHINE COMPRISING A YARN RETURN UNIT

FIELD OF THE INVENTION

The present invention relates to a method for identifying a spinning rotor on a rotor spinning machine, wherein the spinning rotor is mounted in a suspended manner in an at least radially acting magnetic bearing and rotates in the bearing during a spinning operation, and wherein at least one variable system variable is compared to at least one reference value. Moreover, the invention relates to a rotor spinning machine for applying the method.

BACKGROUND

In a rotor spinning machine, textile fibers are compacted into yarns, in a known way, via the rotation of a spinning rotor at a high rotational speed. The spinning rotor is generally composed of a rotor cup, in which the yarn production takes place, and a rotor shaft, which is utilized for torque transmission and for the coupling to a bearing. Modern rotor spinning machines comprise, as is known, a plurality of individual workstations. These machines are capable of manufacturing different yarns, for example, from different materials. Various requirements can be placed on the spinning rotors. For this reason, it is typical to provide replaceable spinning rotors having different sizes and/or shapes. The circumference and the shape of the rotor cup, in particular, can be varied. Upon the changeover of the spinning rotors, the permissible operating parameters of the workstation and/or the spinning machine can change. In order to ensure a uniform yarn quality and a high level of operational reliability, there is a need, therefore, for methods and devices for automatically identifying the installed spinning rotor.

DE 10 2007 028 935 A1 describes a method for detecting soiling or defects in a magnetic bearing of a rotor of an electric machine, in which variable system variables are determined and compared to reference values while the rotor is lifted out of different axial end positions. In the case of a deviation that is too great, for example, the machine is prevented from starting. On the one hand, in the known method, only one axial degree of freedom of movement is utilized for determining the variable system variable. On the other hand, defects or soiling, and not the installed spinning rotor, are/is identified with the aid of the method.

SUMMARY OF THE INVENTION

A problem addressed by the present invention is therefore that of refining the known method in such a way that an identification of an installed spinning rotor is made possible. Additional objects and advantages of the invention will be set forth in part in the following description, or may be obvious from the description, or may be learned through practice of the invention.

The problem is solved using a method and a rotor spinning machine having the features described and claimed herein.

The method according to the invention is utilized for identifying a spinning rotor on a rotor spinning machine, wherein the spinning rotor is mounted in a suspended manner in an at least radially acting magnetic bearing and rotates in the bearing during a spinning operation. At least one variable system variable is compared to at least one reference value. It is provided that the at least one variable system variable is an energy consumption of the bearing, a radial position of the spinning rotor, and/or a resonant frequency of the spinning rotor.

The aforementioned variable system variables are directly dependent on the physical properties of the spinning rotor and, therefore, are particularly suitable for identifying the spinning rotor. The, in particular, automatic detection of the spinning rotor by the rotor spinning machine can ensure that the spinning machine can be operated, for example, only with the operating parameters that have been adapted to the individual spinning rotor. This limitation can ensure a reliable and efficient operation of the rotor spinning machine.

Preferably, the at least one reference value is established during a calibration. In the process, various spinning rotors are installed into the rotor spinning machine and the corresponding variable system variables are determined. The calibration can take place, for example, by the manufacturer before delivery of the corresponding rotor spinning machine. It is also conceivable, however, that the user of the rotor spinning machine performs any necessary calibration him/herself.

In one advantageous refinement of the method, the spinning rotor is mounted in a suspended manner in an at least radially acting electromagnetic bearing, wherein at least the radial position of the spinning rotor is actively influenced by the bearing. An active electromagnetic bearing can, on the one hand, dampen undesirable vibrations of the spinning rotor during the spinning operation. On the other hand, the active bearing can also contribute to the identification of the spinning rotor, in that the radial position of the spinning rotor is influenced in a certain way and the effects of this influencing are determined (see below). Conversely, a prior identification of the spinning rotor is also advantageous for an open-loop control of the bearing. In this way, for example, when the mass of the spinning rotor is known, the effects of damping interventions by the bearing can be predicted and appropriately metered. If the bearing additionally acts in an axial direction, it is also conceivable, of course, that an axial position of the spinning rotor is actively influenced by the bearing.

It is advantageous when a radial position of the spinning rotor is detected by at least one sensor and/or by the bearing. With the aid of the sensor, the radial position of the spinning rotor can be determined as a variable system variable. The sensor can also detect vibrations of the spinning rotor and, therefore, be utilized as a basis for damping interventions by the bearing. The sensor can be designed as an inductive, capacitive, magnetic, or optical path sensor. An embodiment as an eddy current sensor is also conceivable. Due to the measurement of vibrations, it is also possible to determine the resonant frequency of the spinning rotor (see below).

At least one change of the position of the spinning rotor can also be detected by a signal induced in the bearing. In this way, an additional position sensor may be dispensed with or an accuracy of the position detection can be increased via the joint use of at least one sensor and the bearing. It is also conceivable that an axial position of the spinning rotor is detected by a sensor.

Moreover, it is an advantage when the position of the suspended spinning rotor is varied in such a way that the energy consumption of the bearing is minimized and, thereafter, the position is compared to at least one position reference value. On the one hand, a minimized energy consumption of the bearing is advantageous per se for the energy consumption of the rotor spinning machine. On the other hand, the position, in particular the radial position, that is assumed during a minimized energy consumption of the bearing enables inferences to be drawn regarding the physical properties of the spinning rotor. It is fundamental, for this purpose, that there is only one position of minimum energy consumption of the bearing for a certain spinning rotor, and that this minimum energy consumption depends, for example, on the mass of the spinning rotor. The variation of the position of the spinning rotor and the minimization of the energy consumption of the bearing can take place while the spinning rotor is not rotating. On the other hand, it is conceivable, however, to carry out the method while the spinning rotor is rotating.

It is advantageous when the spinning rotor is brought into a defined radial position and, thereafter, the energy consumption of the bearing is compared to at least one energy consumption reference value. In contrast to the above-described procedure, it is possible to establish the radial position of the spinning rotor and determine the energy consumption of the bearing while this position is assumed. This energy consumption is therefore characteristic, once again, for the particular spinning rotor, since it depends, for example, on the mass of the spinning rotor. Similarly to the previous case, the method preferably takes place while a spinning rotor is not rotating. It is also conceivable, however, to determine the energy consumption of the bearing while a spinning rotor is rotating in an established radial position. The energy consumption depends on the vibrations and/or characteristic imbalances of the spinning rotor and, therefore, can be utilized for the purpose of identification.

Advantageously, the spinning rotor is caused, by the bearing, to oscillate and the resonant frequency of the spinning rotor is determined from a subsidence behavior of the oscillation. Thereafter, the resonant frequency is compared to at least one resonant frequency value. The resonant frequency of the spinning rotor, as a rigid body, is also characteristic for a certain shape and mass and, therefore, is suitable for the purpose of identification. The active bearing can impart a motion impulse to the spinning rotor and the decay time of the arising oscillation can be determined with the aid of the sensor or via the bearing. The particular spinning rotor can be identified on the basis of this oscillation behavior.

Additionally, it is advantageous when the resonant frequency of the spinning rotor is determined during an acceleration of the spinning rotor on the basis of an increase of an amplitude of an oscillation of the spinning rotor and, thereafter, the resonant frequency is compared to at least one resonant frequency reference value. In this case, advantage is taken of the fact that the spinning rotor vibrates on its own during the rotation. The maximum amplitude of the vibration arises when the spinning rotor rotates at a rotational speed that corresponds to its resonant frequency. This rotational speed is also referred to as critical speed. For the method, the spinning rotor does not need to be accelerated to the critical speed, however. The critical speed can be extrapolated from the increase of the amplitude of the vibration. It would be conceivable, however, to accelerate the spinning rotor up to greater than the critical speed and measure the resonant frequency directly. An extrapolation would not be necessary in this case. The amplitude of the vibration can be measured, in any case, with the aid of the above-described sensor and/or via signals induced in the bearing.

It is particularly advantageous when a mass, a shape, a volume, and/or a material of the spinning rotor are/is determined from the comparison of the variable system variable with the reference value. The aforementioned physical properties are closely related to one another and directly influence the variable system variables described. It is conceivable that one of the aforementioned physical properties is the same in different spinning rotors. For example, it is conceivable that, although two spinning rotors do not have the same mass, they have the same shape and/or the same volume. For this reason, it can be meaningful to determine several of the properties, in order to arrive at an unambiguous identification.

For a reliable and efficient operation of the rotor spinning machine, it is particularly advantageous when a functional scope of the spinning operation is established on the basis of the comparison of the variable system variable with the reference value. Different spinning rotors can be loaded differently and are particularly suitable for manufacturing different yarns. The functional scope of the spinning operation refers, on the one hand, to general operating parameters of the rotor spinning machine. For example, the maximum rotational speed or a maximum torque can be limited during the acceleration of the spinning rotor, depending on the result of the identification. Cleaning or maintenance intervals can also be adapted to the spinning rotor. On the other hand, it is also conceivable that only certain yarns are offered to an operator of the rotor spinning machine, preferably in connection with an article management system, depending on the spinning rotor that is installed. An article management system manages settings of the rotor spinning machine for manufacturing certain yarns. It is conceivable that the installation of a certain spinning rotor is proposed upon selection of a certain yarn or recipe from the article management system.

The rotor spinning machine according to the invention comprises at least one workstation. The at least one workstation comprises a spinning rotor, which is mounted in a suspended manner in an at least radially acting magnetic bearing and rotates within the bearing during a spinning operation. The at least one workstation also comprises a control system. It is provided that the control system is designed for carrying out an identification of the spinning rotor, wherein at least one variable system variable is compared to at least one reference value, wherein the at least one variable system variable is an energy consumption of the bearing, a radial position of the spinning rotor, and/or a resonant frequency of the spinning rotor. As described above, a preferably automated identification of the installed spinning rotor on the basis of its physical properties can improve the reliability and the efficiency of the operation of the rotor spinning machine. Of course, the spinning rotor or at least parts of the spinning rotor of the rotor spinning machine is/are replaceable. In particular, the rotor cup of the spinning rotor is replaceable.

The rotor spinning machine can comprise a plurality of workstations, which can be operated independently of one another, in particular at least in part. Each workstation comprises a separate spinning rotor, which is preferably driven by a single drive. Further features of the workstation of the rotor spinning machine can be, in particular, opening rollers and winding rollers as well as yarn sensors and suction devices. The control system of the workstation can be connected to control systems of other workstations and/or to a higher-order machine control system. The control system can be designed, for example, as an integrated circuit.

In one advantageous embodiment of the rotor spinning machine, the bearing is an electromagnetic bearing comprising at least one electromagnet. Such a bearing allows for the active adjustment of the position of the spinning rotor and, therefore, for example, an alignment in which a low energy consumption of the bearing and/or of the drive prevails. In addition, vibrations of the spinning rotor can be damped by the bearing or minimized by an advantageous positioning of the spinning rotor. As described above, the active bearing can be utilized for the method for identifying the spinning rotor, in that, on the one hand, the energy consumption of the bearing is minimized via the variation of the position of the spinning rotor, or in that a characteristic energy consumption of the bearing is determined in a given position. The bearing can comprise multiple bearing elements, for example, bearing rings. In particular, two bearing elements are provided. The position of the spinning rotor can be adjusted with the aid of the current flowing in a winding of the at least one electromagnet. The bearing can comprise electromagnets as well as permanent magnets. Preferably, an additional safety bearing is provided for the case that the bearing fails.

In addition, it is advantageous when the control system is connected to at least one sensor for detecting a position and/or a movement of the spinning rotor. The sensor can be designed as an inductive, capacitive, magnetic, or optical path sensor. An embodiment as an eddy current sensor is also conceivable. In particular, two sensors are provided. As described above, alternatively or additionally, the bearing can be utilized for detecting the movement of the spinning rotor. For this purpose, changes in current and/or voltage in windings of the bearing can be evaluated.

In particular, it is advantageous when the bearing additionally acts in an axial direction or when an additional axial bearing is provided. In the case of an axial effect of the bearing, at least one additional axial bearing element may be necessary. A shared open-loop control of the position of the spinning rotor in the radial and axial directions can be advantageous, in that energy consumption and vibrations are further reduced.

The additional axial bearing can also be magnetic and, in particular, active. Preferably, the axial bearing comprises at least one electromagnet. It is also conceivable that the axial bearing comprises at least one permanent magnet.

One further advantage arises when the control system is connected to an article management system. An article management system can provide, to an operator of the rotor spinning machine, a database of yarns to be manufactured, including the associated operating parameters and setting values for the rotor spinning machine. The appropriate operating parameters and setting values can be preferably automatically applied on the rotor spinning machine upon selection of a yarn to be manufactured. The selection of possible yarns can depend, in this case, on the installed spinning rotor and/or on a successful identification of the spinning rotor. The article management system can be designed as a central computer, integrated into a control system of the rotor spinning machine, or made available from a central location via the Internet. It is conceivable that the database of the article management system also contains reference values for the variable system variables.

It is a further great advantage when the control system comprises a memory for position reference values, energy consumption reference values, and/or resonant frequency reference values. With the aid of the memory, it is particularly easy to provide these values individually for every workstation and to utilize them for the identification of the spinning rotor according to the invention. The reference values can be determined, for example, by the manufacturer of the rotor spinning machine and, in particular, within the scope of an initial start-up, and can be stored in the memory. Alternatively, it is conceivable that these reference values are stored in a, in particular central, memory and that the control system is connected to the memory or that these reference values are made available by the manufacturer, for example, via the Internet.

BRIEF DESCRIPTION OF THE DRAWINGS

Further advantages of the invention are described in the following exemplary embodiments. Wherein.

DETAILED DESCRIPTION

Figure 1:
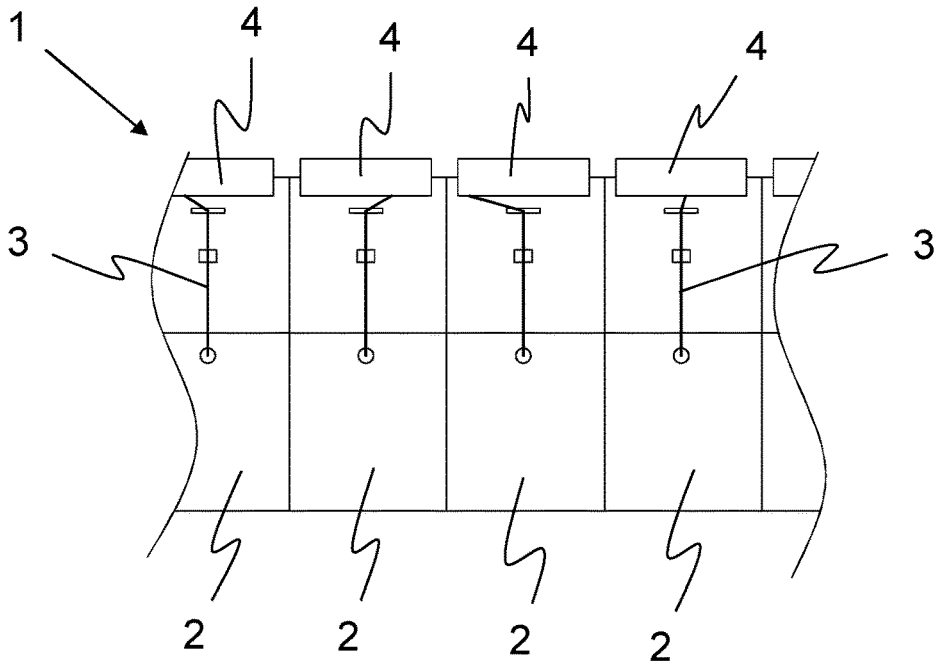
FIG. 1 shows a front view of a rotor spinning machine according to the invention.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

In the following description of the figures, the same reference signs are utilized for features that are identical and/or at least comparable in each of the various figures. The individual features, their embodiment and/or mode of operation are explained in detail usually only upon the first mention thereof. If individual features are not explained in detail once more, their embodiment and/or mode of operation correspond/corresponds to the embodiment and mode of operation of the features that act in the same way or have the same name and have already been described.

FIG. 1 shows a rotor spinning machine 1 according to the invention, comprising multiple workstations 2 in which textile fibers are spun into yarns 3 in the known rotor spinning process. The yarn 3 is wound onto a package 4 in each case. The workstations 2 each comprise a spinning rotor 5 including a magnetic bearing 6 and a control system 7 (see FIG. 2). The control system 7 is designed, in each case, for carrying out an identification of the spinning rotor 5, wherein at least one energy consumption of the bearing 6, a radial position of the spinning rotor 5, and/or a resonant frequency of the spinning rotor 5, as a variable system variable, are/is compared to at least one appropriate reference value.

Figure 2:
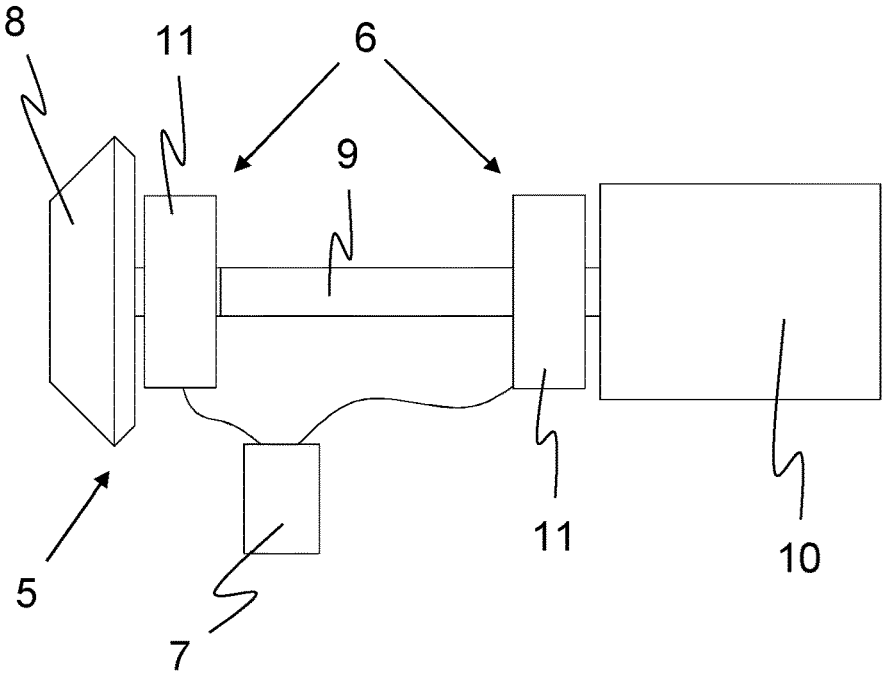
FIG. 2 shows a spinning rotor of the rotor spinning machine according to the invention, including a bearing and a drive.

FIG. 2 shows a view of the spinning rotor 5 installed in one of the workstations 2, comprising the magnetic bearing 6 and the control system 7. The spinning rotor 5 is composed of a rotor cup 8 and a rotor shaft 9, wherein the rotor cup 8 and the rotor shaft 9 are preferably detachably connected to one another. The yarn production takes place in the rotor cup 8 during the spinning operation, wherein the rotor cup 8 has a certain shape, which is particularly suitable for producing certain yarns 3. The entire spinning rotor 5 or at least the rotor cup 8 can be replaced according to demand, which makes it necessary to carry out an identification of the spinning rotor 5, as automatically as possible, with the aid of the control system 7.

The rotor shaft 9 is utilized for the coupling to the bearing 6 and a drive 10. The drive 10 can be designed, for example, as an electric motor, wherein, in this case, the rotor shaft 9 can simultaneously be the rotor of the electric motor. In this example, the bearing 6 comprises two bearing elements 11, which are preferably designed as bearing rings. The bearing elements 11 can comprise electromagnets and, possibly, permanent magnets and are connected to the control system 7.

The control system 7 can, for example, actively control, by way of a closed-loop system, the radial position of the suspended spinning rotor 5 and, for example, dampen unintended vibrations during the spinning operation. The bearing elements 11 can be utilized as position sensors of the spinning rotor 5, since movements of the spinning rotor 5 result in changes of the current and/or of the voltage in the electromagnets of the bearing elements 11.

As described above, multiple procedures are conceivable for identifying the spinning rotor 5. For example, the position of the spinning rotor 5 can be varied in such a way that the energy consumption of the bearing 6, which is necessary in order to hold the spinning rotor 5 in suspension, is minimized. On the other hand, the energy consumption of the bearing 6 can be determined when the spinning rotor 5 is in a predefined position.

The spinning rotor 5 can also be identified on the basis of its resonant frequency. The resonant frequency is characteristic for the mass and the shape of the spinning rotor 5. On the one hand, the resonant frequency can be determined on the basis of the increase of the amplitude of the vibration of the spinning rotor 5 during the accelerated rotation. On the other hand, the spinning rotor 5 can also be caused, by the bearing 6, to oscillate and the resonant frequency can be determined on the basis of the subsidence behavior, in particular the decay time, of the oscillation. In each of these cases, a variable system variable is determined, which depends on the physical properties of the spinning rotor 5 and which, with the aid of a comparison to known reference values, allows for an assignment of the spinning rotor 5 installed into the workstation 2 of the rotor spinning machine 1.

Figure 3:
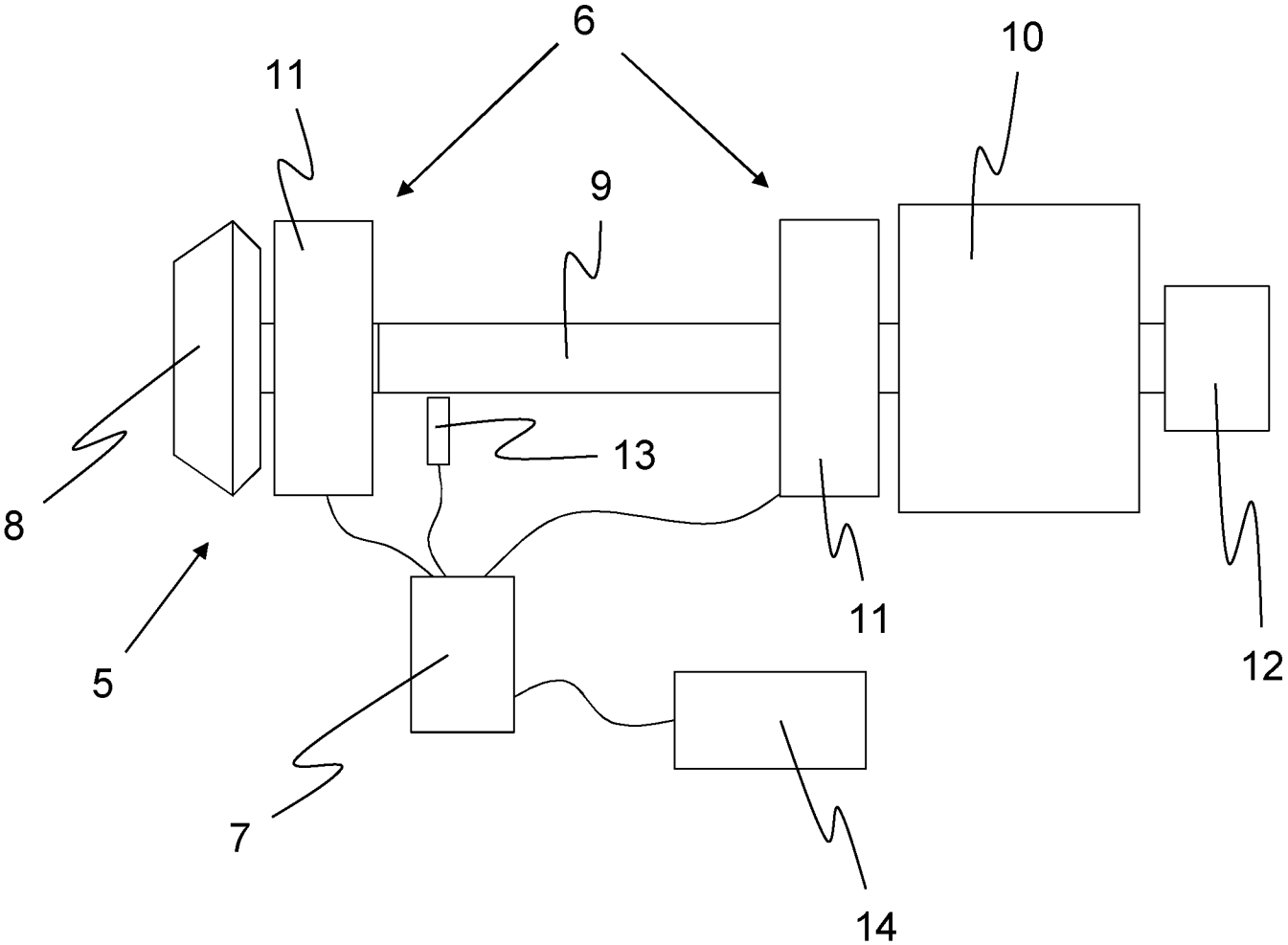
FIG. 3 shows one further exemplary embodiment of a spinning rotor of the rotor spinning machine according to the invention.

FIG. 3 shows the view of one further spinning rotor 5 of the rotor spinning machine 1 according to the invention. In this exemplary embodiment, the shape of the spinning rotor 5, in particular the shape of the rotor cup 8, is changed. The identification of the spinning rotor 5 according to the method according to the invention will therefore yield a different result as compared to the preceding exemplary embodiment. The rotor shaft 9 is connected to an additional axial bearing 12, which is also designed, for example, as a magnetic bearing. In contrast to the preferably active radial bearing 6, the axial bearing 12 can be, for example, passive. The control system 7 in this example is connected, not only to the bearing elements 11 of the radial bearing 6, but also to a sensor 13 for measuring the radial position of the spinning rotor 5. This sensor 13 can, on the one hand, exclusively measure the variable system variable of the position of the spinning rotor 5, or, on the other hand, be used together with the pieces of position and/or movement information of the bearing 6. Of course, movements, such as vibrations, of the spinning rotor 5 can also be measured with the aid of the sensor 13. Further sensors 13 are also conceivable.

Moreover, the control system 7 is connected to an article management system 14, which contains operating parameters and setting values for the rotor spinning machine 1 for manufacturing different yarns 3. With the aid of the method according to the invention for identifying the spinning rotor 5, a preselection of the recipes, made available by the article management system 14, for manufacturing yarns 3 can be carried out, for example, depending on the present spinning rotor 5. It is also conceivable that a recipe selected by an operator is implemented only after a successful identification of the spinning rotor 5, or the operator is prompted to install another spinning rotor 5.

The present invention is not limited to the represented and described exemplary embodiments. Modifications within the scope of the claims are also possible, as is any combination of the features, even if they are represented and described in different exemplary embodiments.

LIST OF REFERENCE NUMBERS

1 rotor spinning machine
2 workstation
3 yarn
4 package
5 spinning rotor
6 bearing
7 control system
8 rotor cup
9 rotor shaft
10 drive
11 bearing element
12 axial bearing
13 sensor
14 article management system

The invention claimed is:

1. A method for identifying a spinning rotor on a rotor spinning machine from other different types of spinning rotors, wherein the spinning rotor is mounted in a suspended manner in an at least a radially acting magnetic bearing and rotates in the bearing during a spinning operation, the method comprising:

identifying at least one system variable that varies between different types of spinning rotors;

detecting the system variable;

comparing the detected system variable to at least one reference value;

wherein the system variable is one or a combination of: an energy consumption of the magnetic bearing; a radial position of the spinning rotor; or a resonant frequency of the spinning rotor; and based on the comparison of the detected system variable and the reference value, one or a combination of the following physical characteristics of the spinning rotor that differentiate one type of spinning rotor from a different type of spinning rotor are determined: a mass of the spinning rotor, a volume of the spinning rotor, a material of the spinning rotor, and dimensions of a size or shape of the spinning rotor.

2. The method as in claim 1, wherein at least the radial position of the spinning rotor is actively influenced by the magnetic bearing.

3. The method as in claim 2, wherein the radial position of the spinning rotor is detected by at least one sensor or by the magnetic bearing.

4. The method as in claim 2, wherein the radial position of the spinning rotor is varied in such a way that the energy consumption of the magnetic bearing is minimized and, thereafter, the radial position is compared to at least one radial position reference value.

5. The method as in claim 2, wherein the spinning rotor is brought into a defined radial position and, thereafter, the energy consumption of the magnetic bearing is compared to at least one energy consumption reference value.

6. The method as in claim 1, wherein the spinning rotor is caused, by the magnetic bearing, to oscillate and the resonant frequency of the spinning rotor is determined from a subsidence behavior of the oscillation and, thereafter, the resonant frequency is compared to at least one resonant frequency reference value.

7. The method as in claim 1, wherein the resonant frequency of the spinning rotor is determined during an acceleration of the spinning rotor based on an increase of an amplitude of an oscillation of the spinning rotor and, thereafter, the resonant frequency is compared to at least one resonant frequency reference value.

8. The method as in claim 1, further comprising establishing a functional scope of the spinning operation based on the comparison of the system variable with the reference value.

9. A rotor spinning machine, comprising:

at least one workstation, the workstation comprising a spinning rotor mounted in a suspended manner in a radially acting magnetic bearing such that the spinning rotor rotates within the magnetic bearing during a spinning operation;

the workstation further comprising a control system configured to identify of the spinning rotor from other different types of spinning rotors by comparing a system variable that varies between different types of spinning rotors with a reference value;

wherein the system variable is one or a combination of: an energy consumption of the magnetic bearing; a radial position of the spinning rotor; or a resonant frequency of the spinning rotor; and based on the comparison of the detected system variable and the reference value, the control system configured to determine one or a combination of the following physical characteristics of the spinning rotor that differentiate the spinning rotor from other different types of spinning rotors: a mass of the spinning rotor, a volume of the spinning rotor, a material of the spinning rotor, and dimensions of a size or shape of the spinning rotor.

10. The rotor spinning machine as in claim 9, wherein the magnetic bearing comprises an electromagnetic bearing with at least one electromagnet.

11. The rotor spinning machine as in claim 9, wherein the control system is connected to a sensor that is configured to detect a position or a movement of the spinning rotor.

12. The rotor spinning machine as in claim 9, wherein the magnetic bearing additionally acts in an axial direction on the spinning rotor.

13. The rotor spinning machine as in claim 9, further comprising an additional axial bearing that acts in an axial direction on the spinning rotor.

14. The rotor spinning machine as in claim 9, wherein the control system is connected to an article management system.

15. The rotor spinning machine as in claim 9, wherein the control system comprises or is connected to a memory that stores the reference values.

* * * * *